US010471293B2

(12) United States Patent
George

(10) Patent No.: US 10,471,293 B2
(45) Date of Patent: Nov. 12, 2019

(54) EXERCISE APPARATUS

(71) Applicant: Victor George, Brooklyn, NY (US)

(72) Inventor: Victor George, Brooklyn, NY (US)

( * ) Notice: Subject to any disclaimer, the term of this patent is extended or adjusted under 35 U.S.C. 154(b) by 35 days.

(21) Appl. No.: 15/880,977

(22) Filed: Jan. 26, 2018

(65) Prior Publication Data

US 2018/0221700 A1 Aug. 9, 2018

Related U.S. Application Data

(60) Provisional application No. 62/456,373, filed on Feb. 8, 2017.

(51) Int. Cl.

| | |
|---|---|
| ***A63B 21/068*** | (2006.01) |
| ***A63B 21/00*** | (2006.01) |
| ***A63B 23/04*** | (2006.01) |
| ***A63B 23/035*** | (2006.01) |
| ***A63B 1/00*** | (2006.01) |
| ***A63B 23/12*** | (2006.01) |
| ***A63B 23/02*** | (2006.01) |
| ***A63B 71/02*** | (2006.01) |

(52) U.S. Cl.

CPC ..... *A63B 21/068* (2013.01); *A63B 1/00* (2013.01); *A63B 21/00047* (2013.01); *A63B 23/0355* (2013.01); *A63B 23/0405* (2013.01); *A63B 21/4035* (2015.10); *A63B 23/0216* (2013.01); *A63B 23/1218* (2013.01); *A63B 23/1227* (2013.01); *A63B 23/1236* (2013.01); *A63B 2023/0411* (2013.01); *A63B 2071/025* (2013.01); *A63B 2210/50* (2013.01); *A63B 2225/107* (2013.01)

(58) Field of Classification Search

CPC ... A63B 21/068; A63B 1/00; A63B 21/00047; A63B 23/0355; A63B 23/0405; A63B 2071/025; A63B 2210/50; A63B 21/4035; A63B 2225/107; A63B 23/0216; A63B 23/1218; A63B 23/1236; A63B 2023/0411; A63B 23/1227

See application file for complete search history.

(56) References Cited

U.S. PATENT DOCUMENTS

| | | | | |
|---|---|---|---|---|
| 5,904,637 | A * | 5/1999 | Kuo | A63B 22/02 482/54 |
| 6,149,551 | A * | 11/2000 | Pyles | A63B 22/0664 482/51 |
| 8,834,332 | B2 * | 9/2014 | Campanaro | A63B 21/00072 482/142 |
| 9,265,686 | B1 * | 2/2016 | Pichnarcik | A61H 3/00 |
| 9,579,535 | B2 * | 2/2017 | Markowitz | A63B 21/4035 |
| 9,649,523 | B2 * | 5/2017 | Brady | A63B 21/00047 |
| 9,764,751 | B2 * | 9/2017 | Cho | A45C 5/04 |
| 2012/0053028 | A1 * | 3/2012 | Campanaro | A63B 21/00072 482/131 |
| 2014/0194260 | A1 * | 7/2014 | Campanaro | A63B 21/068 482/131 |

(Continued)

*Primary Examiner* — Garrett K Atkinson

(74) *Attorney, Agent, or Firm* — Abelman, Frayne & Schwab

(57) ABSTRACT

A stationary exercise apparatus allows one or two users to execute a wide variety of bodyweight exercises including pull-ups, dips, crunches, leg raises, and inclined push-ups. The apparatus can quickly and easily be folded into a compact configuration for storage, e.g., in a closet or under a bed, without the use of tools.

14 Claims, 16 Drawing Sheets

(56) References Cited

U.S. PATENT DOCUMENTS

| | | | | |
|---|---|---|---|---|
| 2014/0371038 | A1* | 12/2014 | Markowitz | A63B 21/4035 482/123 |
| 2016/0184684 | A1* | 6/2016 | Ray | A63B 69/004 482/89 |
| 2017/0144684 | A1* | 5/2017 | Cho | A45C 5/04 |
| 2018/0056162 | A1* | 3/2018 | Hollist | A63B 69/0097 |

* cited by examiner

EXERCISE APPARATUS

FIELD OF THE INVENTION

The invention is a stationary exercise apparatus designed to allow one or two users to execute a wide variety of bodyweight exercises including pull-ups, dips, crunches, leg raises, and inclined push-ups.

BACKGROUND OF THE INVENTION

Some bodyweight exercises can be performed without any equipment, including isometric exercises and pushups, while other exercises are enhanced or made possible with the incorporation of exercise equipment. Exercise equipment is commonly found in gyms or in parks. Home exercise equipment is also popular, though space constraints often mandate that the equipment be foldable and movable for storage when not in use. Some bodyweight exercises requiring equipment, such as pull-ups, can be performed in a user's home through the installation of a pull-up bar, such as in a doorframe, but there is a need for a sturdy apparatus that permits the user to undertake a broad range of bodyweight exercises, while being compact, easy to set up, easy to fold and transport for storage.

SUMMARY OF THE INVENTION

The present invention discloses an exercise apparatus that is ideal for home use, as well as being suitable for gyms, physical therapy, and other facilities. The apparatus is comprised of a left base frame and a right base frame, which when set up for use is approximately 48" long, 28" wide, and 48" high. When the apparatus is folded for storage, it is approximately 48" long, 10½" wide, and 48" high.

The exercises that can be performed are almost limitless and include exercises that work out the chest, back, legs, arms, and abdominal muscles. The preferred embodiment of the present invention can be utilized by a user in a simple and effortless manner to perform total body exercises at virtually any location in a manner which is not only quick, easy, and effective, but can be performed with a minimal amount of training and/or experience after initial purchase or acquisition of the apparatus.

BRIEF DESCRIPTION OF THE DRAWINGS

Preferred embodiments of the invention are described below with reference to the drawings wherein.

DETAILED DESCRIPTION OF THE INVENTION

Figure 1:
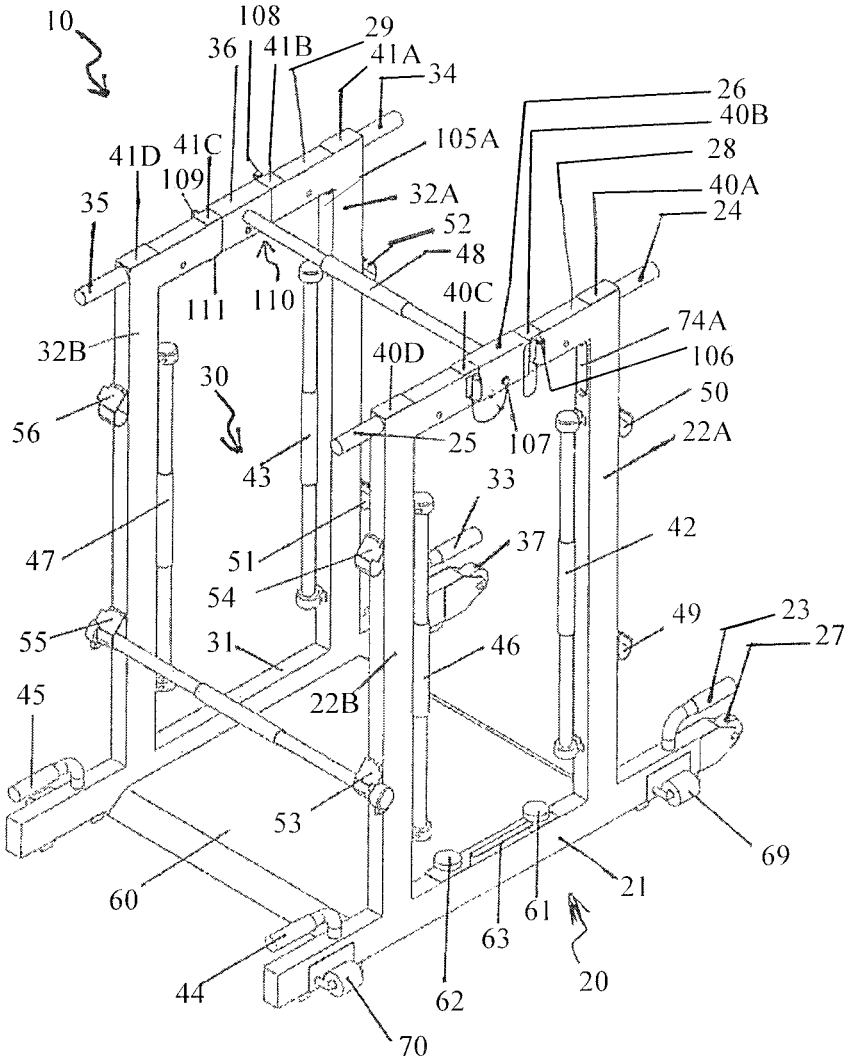
FIG. 1 illustrates a front, right side, and top isometric view of the exercise apparatus.

As shown in FIG. 1, the exercise apparatus 10 comprises a right base frame structure 20 and a left base frame structure 30.

The right base frame structure 20 is comprised of a first base member 21, a pair of first upright members 22A, 22B, and a first top member 28.

Figure 4:
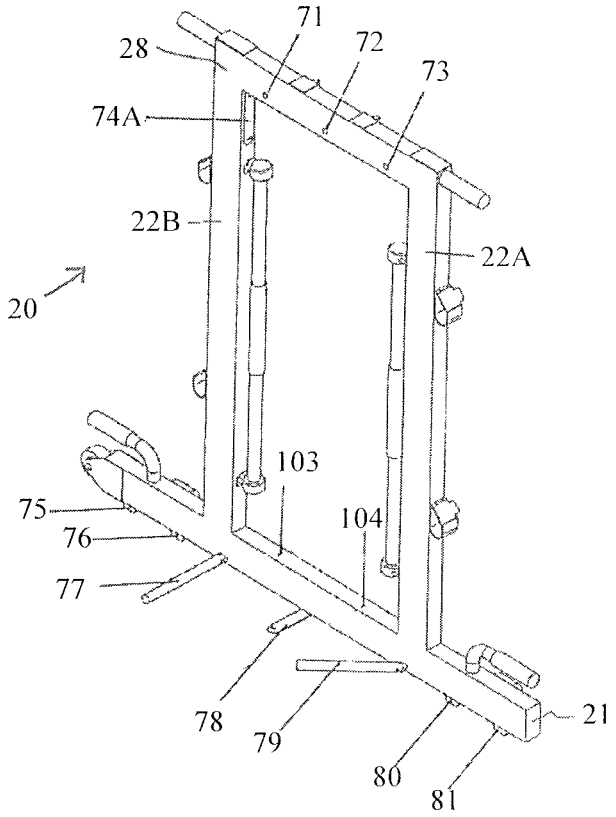
FIG. 4 illustrates the right base frame of the exercise apparatus.

As shown in FIG. 4, first base member 21 is configured to support the right base frame structure 20 on a horizontal surface such as a floor, and in a preferred embodiment includes base supports 75, 76, 80, and 81, which are secured to the underside of first base member 21, and which base supports make direct contact with the horizontal surface. Also provided for first base member 21 are first and second hinged supports 77, 78, and a bottom latch 78. The top of first base member 21 is provided with first and second threaded apertures 103, 104. First top member 28 is provided with first, second, and third apertures 71, 72, 73.

Figure 2:
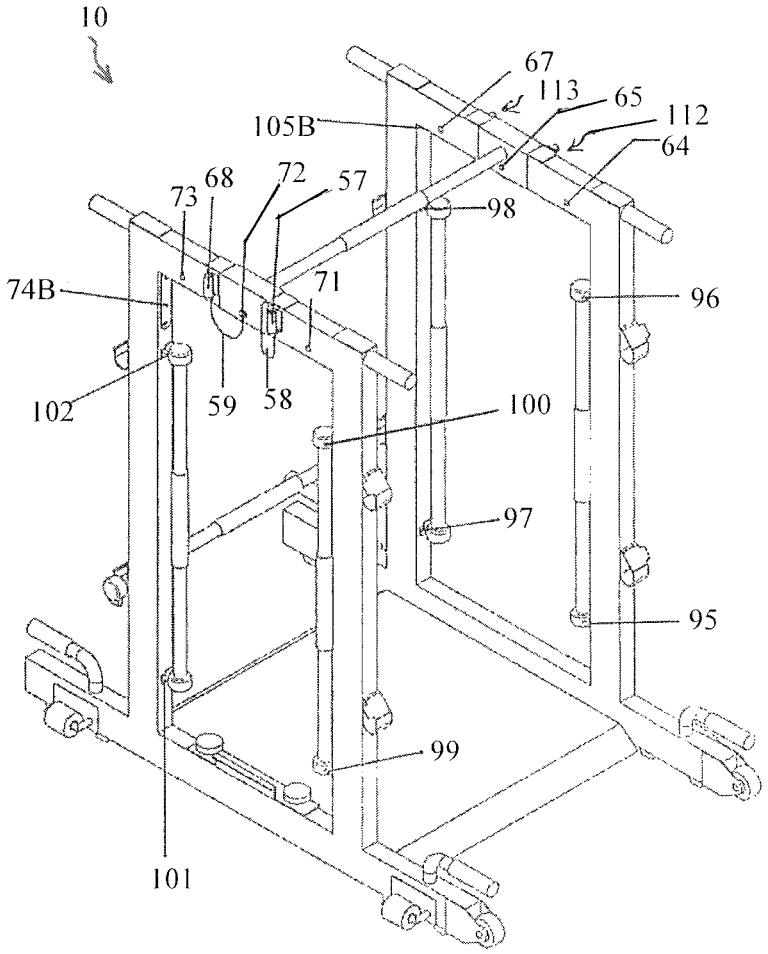
FIG. 2 illustrates a rear, right side, and top isometric view of the exercise apparatus.

As shown in FIGS. 1, 2, and 4, first upright members 22A, 22B are provided with first and second top latches 74A, 74B.

As shown in FIG. 1, first base member 21 is provided with wheels 27, 69, 70. The top of first base member 21 is provided with lower handles 23, 44.

First upright members 22A, 22B are also provided with lower brackets 49, 53, and with upper brackets 50, 54. As shown in FIGS. 1 and 2, first upright members 22A, 22B are also provided with bar hangers 99, 100, 101, 102, for storage for crossbars 42, 46 when not in use.

First top member 28 is provided with upper handles 24, 25, with stoppers 40A, 40B, 40C, 40D, and with protective collar 26.

The left base frame structure 30 is comprised of a second base member 31, a pair of second upright members 32A, 32B, and a second top member 29.

Figure 3:
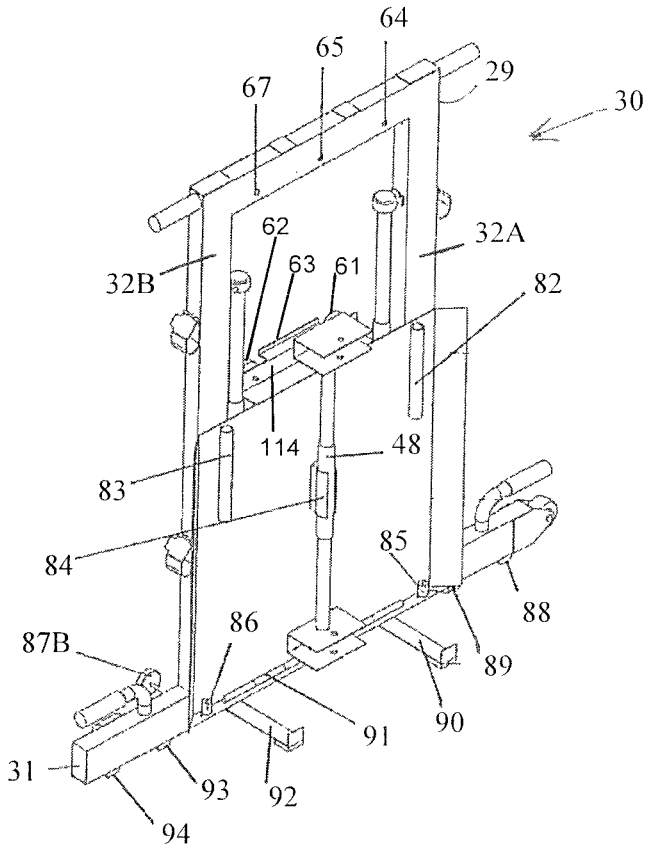
FIG. 3 illustrates the left base frame of the exercise apparatus.

As shown in FIG. 3, second base frame 31 is configured to support the left base frame structure 30 on the horizontal surface, and in a preferred embodiment includes base supports 88, 89, 93, and 94, which are welded underneath second base member 31, and which base supports make direct contact with the horizontal surface. Also provided for second base member 31 are first and second bottom supports 90, 92.

As shown in FIGS. 1 and 3, left base frame structure 30 includes bottom plate 60, which is attached to second base member 31 by friction hinge 91. Bottom plate 60 is provided with first and second apertures 82, 83 and first and second threaded apertures 85, 86. Bottom plate 60 is also provided with clip 84 that allows for storage of upper cross bar 48. As shown in FIG. 3, Bottom plate 60 includes a flange 114 at the side opposite second base member 31. Bottom plate flange 114 includes bottom plate handle 63 and threaded bolts 61, 62.

Second top member 28 is provided with fourth, fifth, and sixth apertures 64, 65, 67.

As shown in FIGS. 1 and 2, second upright members 32A, 32B are provided with latch hooks 105A, 105B.

Figure 7A:
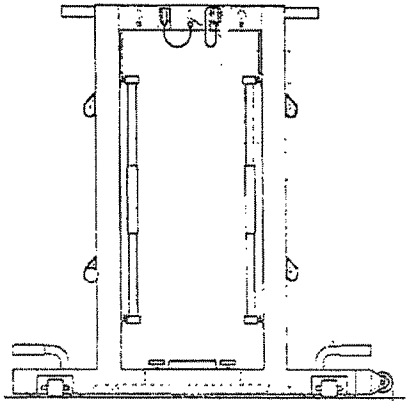
FIG. 7A is a right side elevation of the exercise apparatus.
Figure 7B:
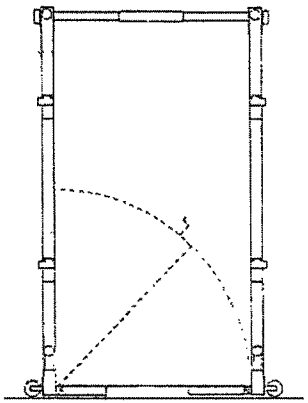
FIG. 7B is a front elevation of the exercise apparatus.
Figure 7C:
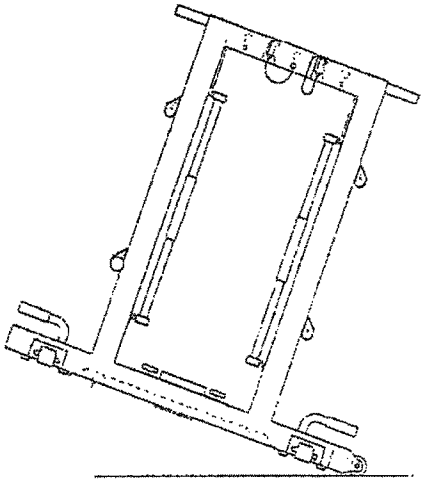
FIG. 7C is a right side elevation of the exercise apparatus tilted for rolling on the rear wheels.
Figure 7D:
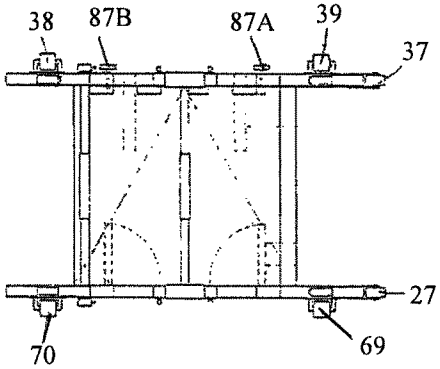
FIG. 7D is a plan view of the exercise apparatus.

As shown in FIGS. 1 and 7D, second base member 31 is provided with wheels 37, 38, 39. The top of second base member 31 is provided with lower handles 33, 45.

Second upright members 32A, 32B are provided with lower brackets 51, 55, and with upper brackets 52, 56. As shown in FIGS. 1 and 2, second upright members 32A, 32B are also provided with bar hangers 95, 96, 97, 98, for storage for crossbars 43, 47 when not in use.

Second top member 29 is provided with upper handles 34, 35, with stoppers 41A, 41B, 41C, 41D, and with protective collar 36.

When stored, the right base frame structure 20 and left base frame structure 30 are latched together. To set up the exercise apparatus 10 for use, the apparatus is positioned up-right on a floor or other a level surface, and the top latches 74A, 74B, 105A, 105B and bottom latch 78 are released.

Right base frame structure 20 is separated from left base frame structure 30, and first and second hinged supports 77, 79 are rotated to be perpendicular to first base member 21, allowing right base frame structure 20 to stand at an 80-85 degree angle from the floor.

At left base frame structure 30, upper cross bar 48 is removed from clip 84. Bottom plate 60 is pulled down. Right base frame structure 20 and left base frame structure 30 are then aligned, with first and second hinged supports 77, 79 being slid through first and second apertures 82, 83. This helps to align bottom plate 60 into position. The top of bottom plate flange 114 then rests on the top of first base member 21, and bottom plate flange 114 is then locked onto the first base member 21 with threaded bolts 61, 62 going through first and second threaded apertures 103, 104. Threaded bolts 87A, 87B (shown in FIG. 7D) are then placed through second base member 31 into threaded apertures 85, 86, securing bottom plate 60 in the lowered position.

Figure 5:
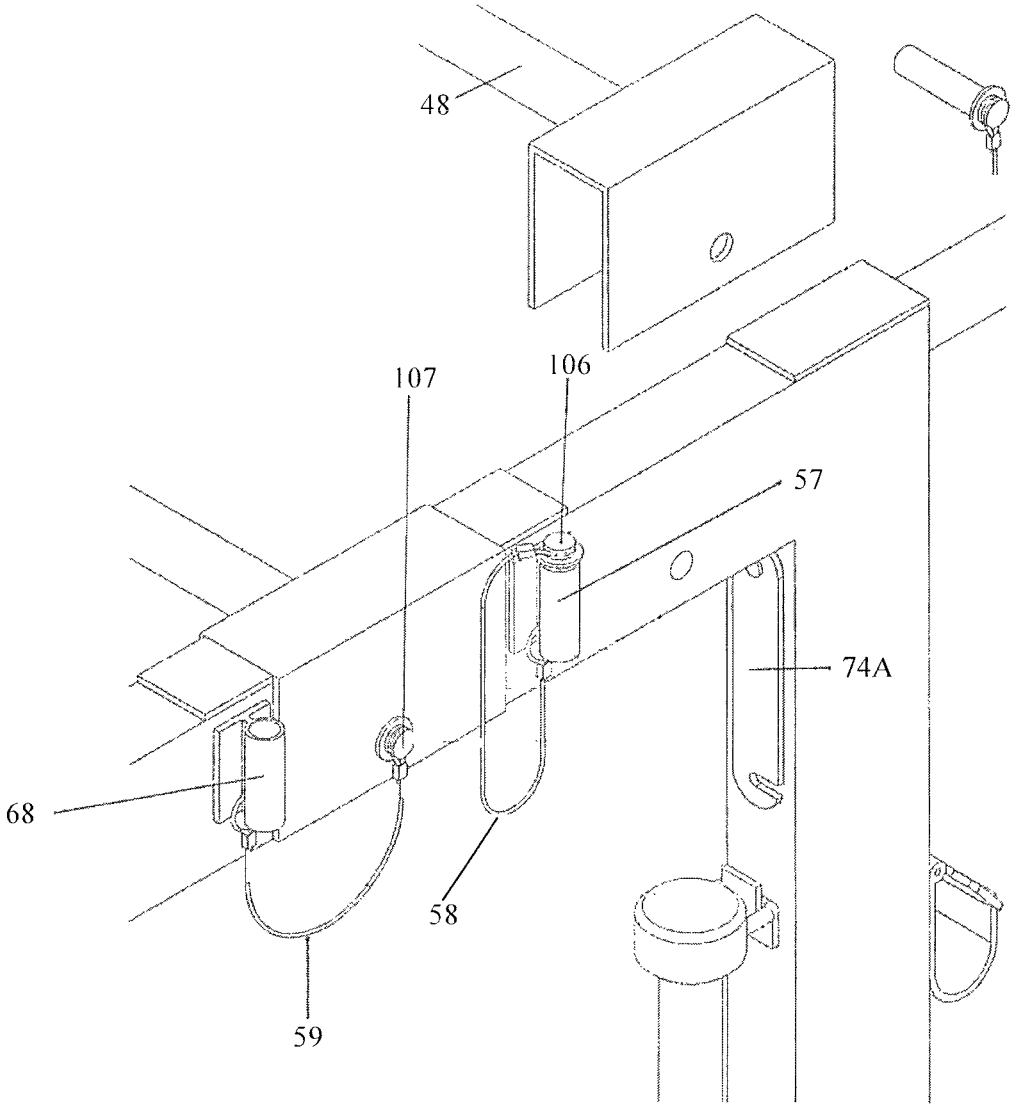
FIG. 5 illustrates a detail of the attachment of an upper cross bar to the top of the right base frame.

Upper cross bar 48 is installed across right base frame structure 20 and left base frame structure 30, over the protective collars 26, 36 installed on first and second top members 28, 29. As shown in FIGS. 1, 2, and the detail of FIG. 5, upper cross bar 48 is secured in place with pins 106, 107, 108, 109. Pins 106, 107, 108, 109 are secured to exercise apparatus 10 by pin cables 58, 59, 110, 111, and when not in use, pins 106, 107, 108, and 109 are placed in pin retainers 57, 68, 112, 113.

Figure 6A:
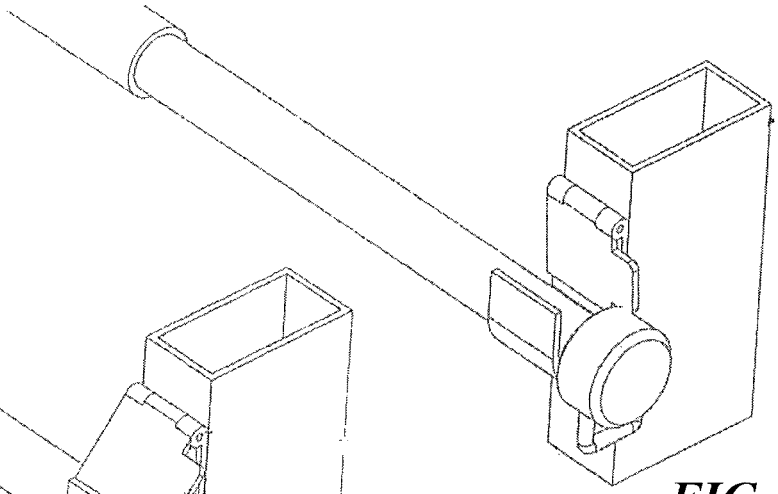
FIGS. 6A and 6B illustrate the installation of a cross bar into a bracket with a spring-loaded finger tab.
Figure 6B:
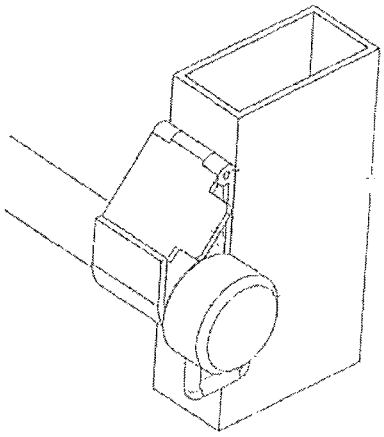

When set up for use, crossbars 42, 46, 43, 47 can be moved from their storage positions on first and second upright members 22A, 22B, 32A, 32B to upper and lower brackets 49-56. FIG. 6A shows the end of one crossbar being installed into a bracket, and FIG. 6B shows the completed placement of the crossbar into the bracket, with the spring-loaded hinge having snapped the finger tab into position to secure the crossbar in place.

All the exercises that can be done on one side of the apparatus by one user can also be done on the opposite side of the apparatus, either by one user or two users at the same time.

Figure 8A:
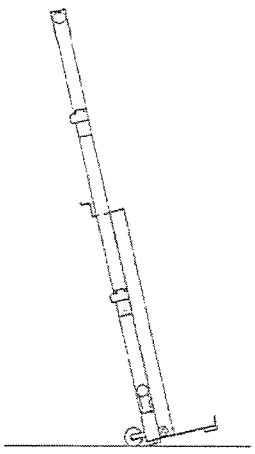
FIG. 8A illustrates the left base frame in a detached state and tilted for rolling on the left side wheels.
Figure 8B:
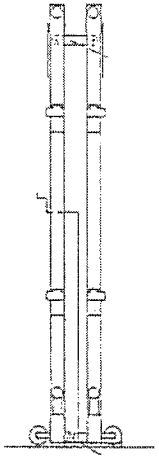
FIG. 8B illustrates the exercise apparatus folded for storage.
Figure 8C:
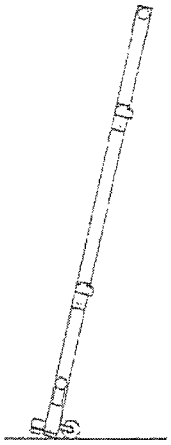
FIG. 8C illustrates the right base frame in a detached state and tilted for rolling on the right side wheels.
Figure 8D:
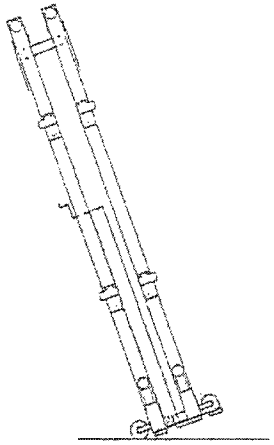
FIG. 8D illustrates the folded exercise apparatus tilted for rolling.
Figure 9:
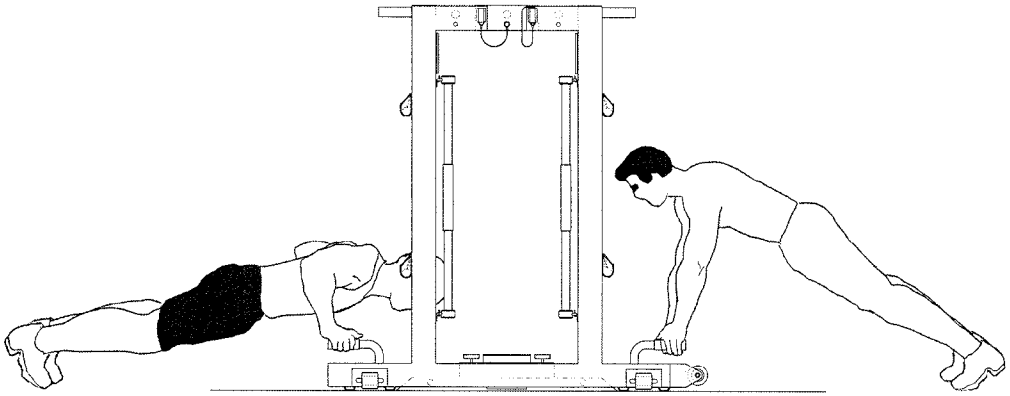
FIGS. 9-16 illustrate various exercises that users can perform with the exercise apparatus.
Figure 10:
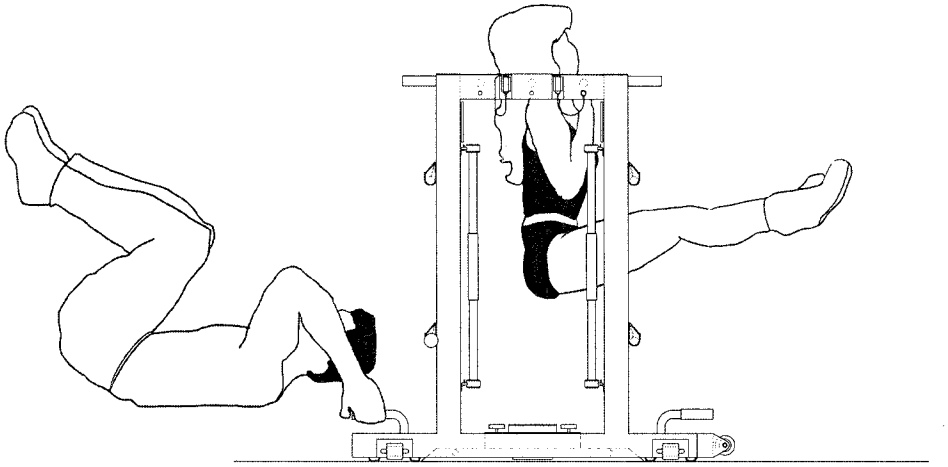
Figure 11:
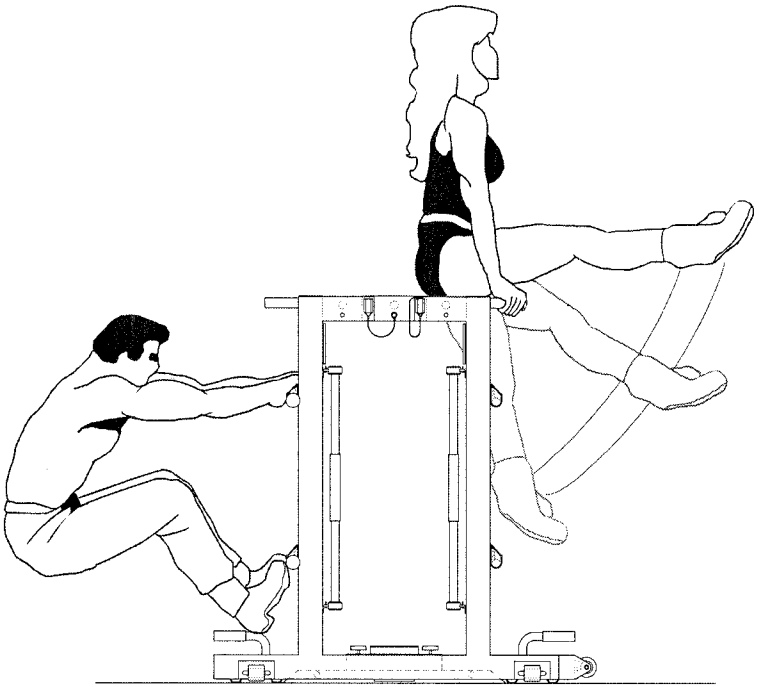
Figure 12:
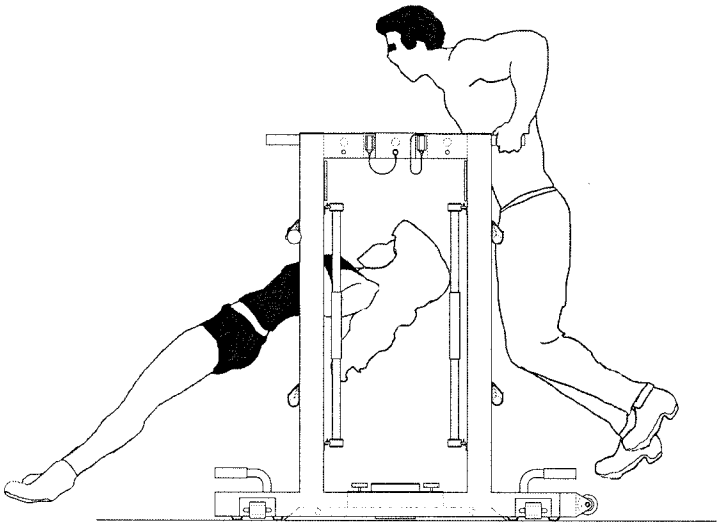
Figure 13:
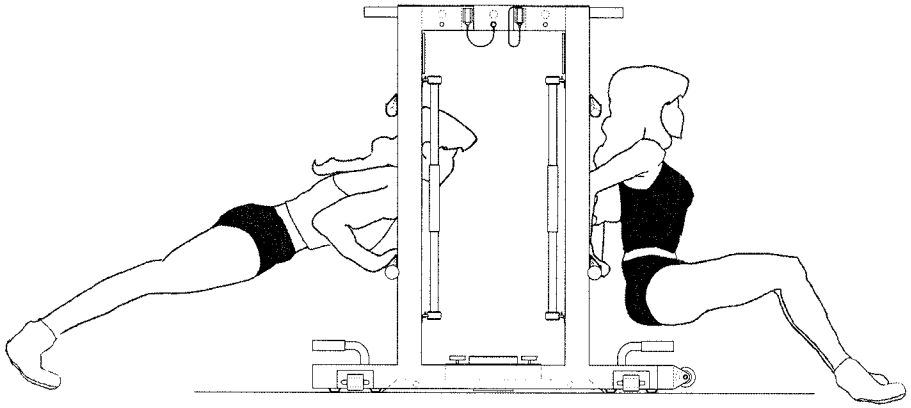
Figure 14:
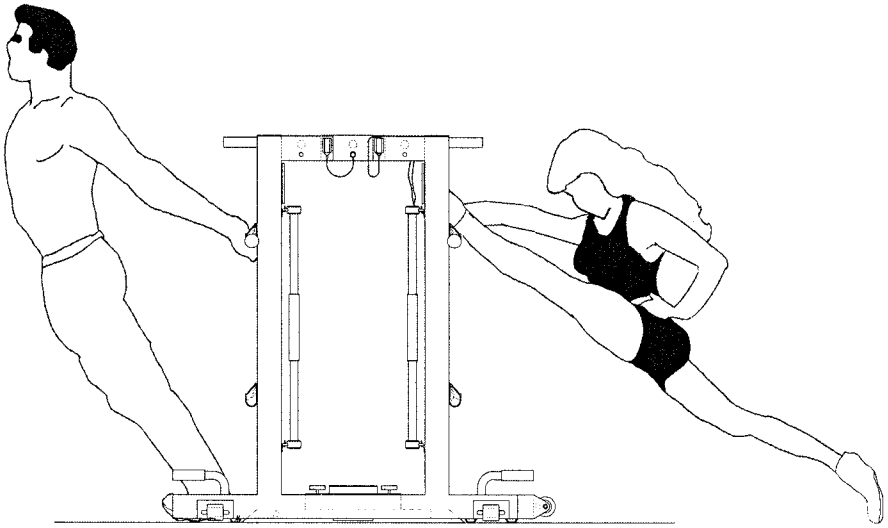
Figure 15:
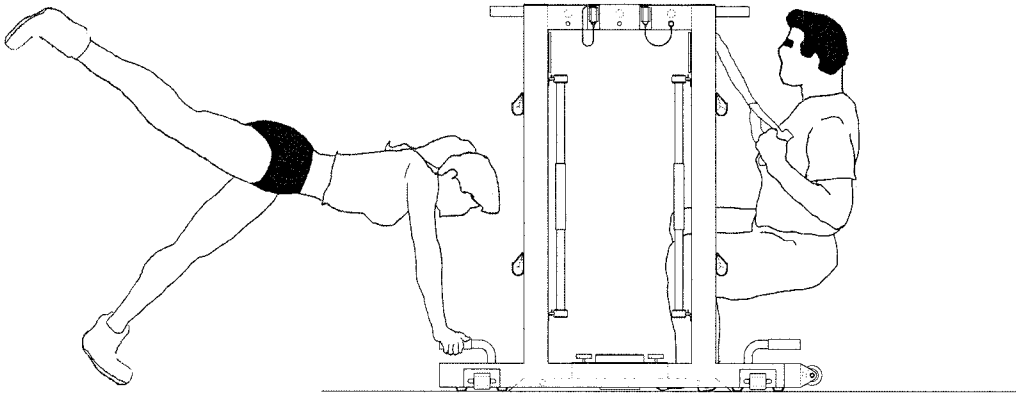
Figure 16:
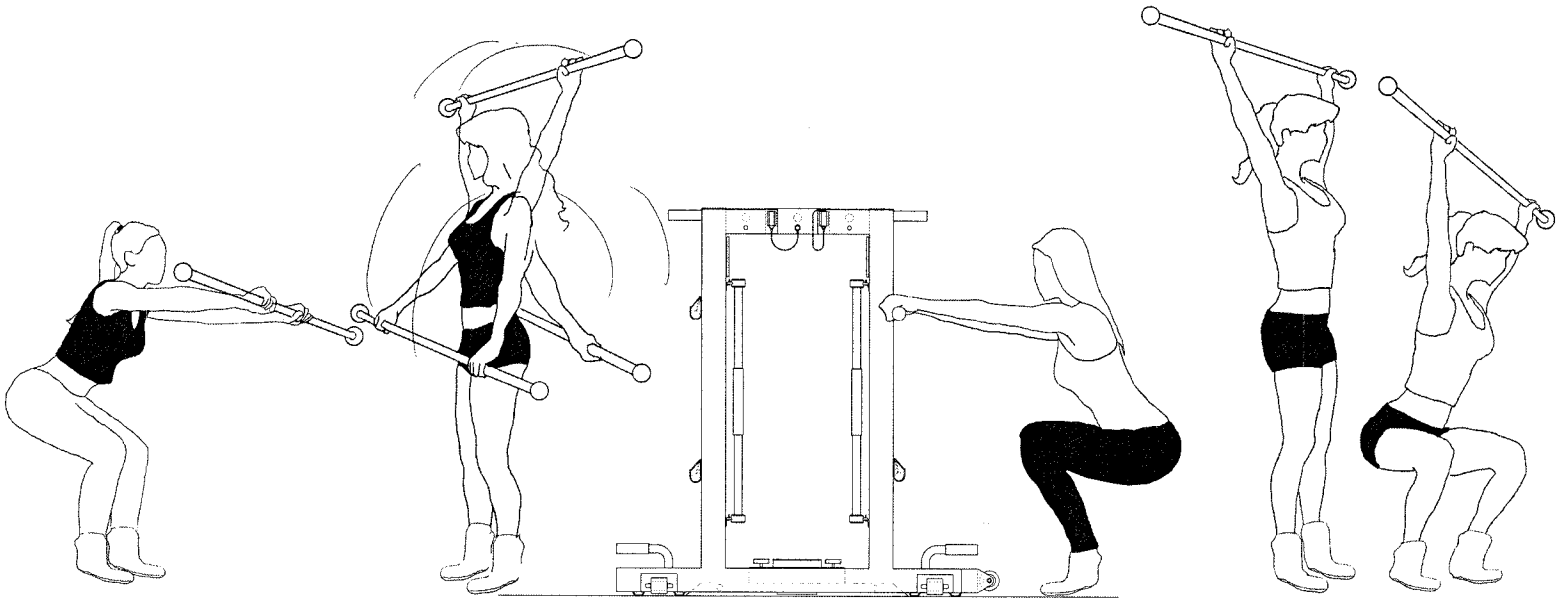

To store the apparatus, the installation instructions described above are reversed. FIG. 8A shows the separated left base frame structure 30, which can be tilted and rolled. FIG. 8C shows the separated right base frame structure 20, which can be tilted and rolled. FIG. 8B shows the exercise apparatus 10 in a latched-closed position. FIG. 8D shows that in the closed and latched position, exercise apparatus 10 can be tilted onto one side and rolled to another location, e.g., for storage.

In a preferred embodiment, first and second base members 21, 31, first and second upright members 22A, 22B, 32A, 32B, and first and second top members 28, 29 are welded from 3"×1½" tube stock that is ⅛" thick.

FIGS. 7A-7D show one embodiment including construction details for exercise apparatus 10.

As illustrated in FIGS. 9-16, a variety of exercises can be performed simultaneously by two users with various arrangements of the cross bars on the exercise apparatus of the invention.

The foregoing descriptions of specific embodiments and sketches of the present invention have been presented for purposes of illustration and description. They are not intended to be exhaustive or to limit the invention to the precise forms disclosed, and obviously many modifications and variations are possible in light of the above teaching.

PART NUMBERS AND DESCRIPTIONS

10 exercise apparatus
20 first frame structure
21 first base member
22A first upright
22B first upright
23 lower handle
24 first upper front handle
25 first upper rear handle
26 first protective collar
27 wheel
28 first top member
29 second top member
30 second frame structure
31 second base member
32 second upright
33 second lower front handle
34 second front upper handle
35 second upper rear handle
36 second protective collar
37 wheel
38 wheel
39 wheel
40A front stopper
40B first center stopper
40C second center stopper
40D rear stopper
41A front stopper
41B first center stopper
41C second center stopper
41D rear stopper
42 first cross bar
43 second cross bar
44 lower handle
45 second lower rear handle
46 first rear cross bar
47 second rear cross bar
48 upper cross bar
49 front lower bracket and spring-loaded finger tab
50 front upper bracket and spring-loaded finger tab
51 front lower bracket and spring-loaded finger tab
52 front upper bracket and spring-loaded finger tab
53 rear lower bracket and spring-loaded finger tab
54 rear upper bracket and spring-loaded finger tab
55 rear lower bracket and spring-loaded finger tab
56 rear upper bracket and spring-loaded finger tab

57 first front pin retainer
58 first front pin cable
59 first rear pin cable
60 bottom plate
61 large front threaded bolt
62 large rear threaded bolt
63 bottom plate handle
64 front aperture
65 center aperture
66 rear aperture
67 first rear pin retainer
69 side wheel
70 side wheel
71 first aperture
72 second aperture
73 third aperture
74A first top latch
74B second top latch
75 first base support
76 second base support
77 first hinged support
78 bottom latch
79 second hinged support
80 third base support
81 fourth base support
82 first welded apertures
83 second welded apertures
84 welded clip
85 first threaded apertures
86 second threaded apertures
87A small front threaded bolt
87B small rear threaded bolt
88 fifth base support
89 sixth base support
90 first bottom support
91 friction hinge
92 second bottom support
93 seventh base support
94 eight base support
95 first bar hanger
96 second bar hanger
97 third bar hanger
98 fourth bar hanger
99 fifth bar hanger
100 sixth bar hanger
101 seventh bar hanger
102 eight bar hanger
103 first threaded aperture
104 second threaded aperture
105A front latch hook
105B rear latch hook
106 first front pin
107 first rear pin
108 second front pin
109 second rear pin
110 second front pin cable
111 second rear pin cable
112 second front pin retainer
113 second rear pin retainer
114 bottom plate flange While preferred embodiments of the present invention have been illustrated and described herein, it will be apparent that such embodiments are provided by way of example only. Numerous variations, changes and substitutions also be apparent to those skilled in the art without departing from the invention, the scope of which is to be determined by the following claims.

I claim:

1. A modular portable exercise apparatus comprising:

a pair of rigid unitary frame structures, each frame structures comprising:

i. an elongated base member (21) dimensioned and configured to support the frame structure on a horizontal surface;

ii. a pair of spaced-apart generally parallel upright members (22) extending vertically from an upper surface of the base member and joined together by a top member (28);

iii. a top member (28) extending between and joined to the upper ends of the upright members (22) and parallel to the base member (21);

b. a bottom plate (60) that is attached to an interior face of a first of the two base members and configured for rotational movement from a first storage position that is generally parallel to upright members (22) and rotatable to a use position that is parallel to the horizontal surface, the bottom plate having a flange (114) extending from the upper surface, the flange being dimensioned and configured to rest upon a portion of the upper surface of the second of the two base members that is generally co-extensive with the horizontal space between the pair of upright members (22), the flange of the bottom plate adapted pass to a plurality of threaded fasteners (61, 62) that are received in the upper surface face of the supporting base member (21) to secure the bottom plate to the second of the base members in fixed relation; and C. at least one upper cross bar (48), the opposite ends of the cross bar being securely attached to generally U-shaped rectilinear protective collars (26, 36) defined by opposing arms joined by an integral linking section, the protective collars being configured and dimensioned to slidingly engage the top members in close-fitting relation to securely maintain the frame structures in a predetermined spaced-apart parallel relation, each of the protective collars adapted to receive at least one locking pin that passes through the opposing arms and an aligned passageway in the respective adjacent top member.

2. The exercise apparatus of claim 1 in which each of the base members (21) includes at least one wheel assembly (27) in which the axis of rotation of the wheel is transverse to the longitudinal axis of the base member, each wheel assembly being securely mounted and extending outwardly in alignment with the longitudinal axis of the base member to position the periphery of the wheel a predetermined distance above the horizontal surface when the base member is positioned for use, whereby the wheel is brought into contact with the surface when the opposite ends of the base members are raised above the surface to move the apparatus to a longitudinally displaced position.

3. The apparatus of claim 1 in which each of the base members includes at least two wheel assemblies (69, 70) that are securely mounted on the outboard side proximate the opposing ends of the base member (21), the axes of rotation of the wheels of the at least two wheel assemblies being parallel to the longitudinal axis of the base member, the surface of the wheels being positioned a predetermined distance above the horizontal surface when the base member is positioned for use, whereby the at least two wheels are brought into contact with the horizontal surface when the opposite base member is elevated above the surface to move the apparatus to a laterally displaced position.

4. The apparatus of claim 2 or 3 which includes a pair of symmetrically positioned handles that are secured to the opposing ends of each of the base members (21), the gripping portion of each of the handles being parallel to the longitudinal axis of the base member.

5. The apparatus of claims 2 or 3 which includes a pair of symmetrically positioned handles (24, 25 34, 35) that are secured to the opposing ends of each of the top members (28), wherein the gripping portion of each of the handles is parallel to the longitudinal axis of the top members (28).

6. The exercise apparatus of claim 1 which includes a handle (63) secured to the upper surface of the flange of the bottom plate (60).

7. The apparatus of claim 1 which includes a plurality of brackets that are mounted on the exterior vertical surfaces of each of the upright members (22, 32) above the base members, the brackets dimensioned and configured to securely retain and support an exercise cross bar in a predetermined position that is parallel to the horizontal surface.

8. The apparatus of claim 7 in which at least two pairs of supporting brackets (49, 53) are mounted on each of the upright members (22) at predetermined spaced-apart positions between the base member (21) and top member (28), wherein a plurality of exercise cross bars can be secured in position when the apparatus is in use.

9. The apparatus of claim 1 that includes a plurality of cross bar hangers (95) that are mounted in spaced-apart pairs on each of the four interior vertical surfaces of the upright members (22, 32) above the base members (21), the hangers being configured and dimensioned to releasably retain an end portion of an exercise cross bar for storage in secure relation.

10. The apparatus of claim 1 that includes supports (77, 79) that are pivotally mounted on at least one of the base members (21), each of the supports being movable from a storage position that is generally parallel with the longitudinal axis of the base member to a supporting position that is perpendicular to the longitudinal axis of the base member, whereby the frame member can be maintained in a generally upright position on the horizontal surface for initial assembly of the two frame members when the supports are extended.

11. The apparatus of claim 1 which includes a plurality of latches and associated latch pins for retaining the two frame structures in closely abutting relation for movement and storage as a unit.

12. The apparatus of claim 11 Which includes one latch pivotally mounted on the underside of one of the base members (21) and two latches pivotally mounted, respectively, on the opposing interior surfaces of one of the upright members (22).

13. The apparatus of claim 1 in which the unitary frame members are fabricated from rigid tubular material.

14. The apparatus of claim 13 in which the tubular material is metal and the members are joined by welding to form the unitary frame structures.

* * * * *